US005658428A

United States Patent [19]

Oulie

[11] Patent Number: 5,658,428

[45] Date of Patent: Aug. 19, 1997

[54] METHOD FOR IMPREGNATION IN A SINGLE-VESSEL HYDRAULIC DIGESTER

[75] Inventor: Finn Oulie, Charlotte, N.C.

[73] Assignee: Kvaerner Pulping Technologies AB, Sweden

[21] Appl. No.: 545,337

[22] Filed: Oct. 19, 1995

[51] Int. Cl.[6] ..... D21C 7/14

[52] U.S. Cl. ..... 162/42; 162/45; 162/243; 162/251

[58] Field of Search ..... 162/17, 19, 39, 162/42, 45, 243, 249, 250, 251

[56] References Cited

U.S. PATENT DOCUMENTS

| | | | |
|---|---|---|---|
| 3,303,088 | 2/1967 | Gessner | 162/19 |
| 5,053,108 | 10/1991 | Richter | 162/237 |
| 5,080,755 | 1/1992 | Backlund | 162/237 |
| 5,302,247 | 4/1994 | Richardson et al. | 162/42 |
| 5,522,958 | 6/1996 | Li | 162/19 |

FOREIGN PATENT DOCUMENTS

| | | |
|---|---|---|
| 0 527 294 A1 | 2/1993 | European Pat. Off. . |
| WO94/11566 | 5/1994 | WIPO . |
| WO94/23120 | 10/1994 | WIPO . |
| WO94/23847 | 10/1994 | WIPO . |

OTHER PUBLICATIONS

Backlund, E.A., "Extended delignification of softwood kraft pulp in a continuous digester," Tappi Journal, vol. 67, No. 11, pp. 62–65, Nov. 1984.

Andtbacka, Stig, "Hur ombyggs kontinuerliga kokar för att möjliggöra förlängd kokning?," Föredrag Pa SPCI, Oct. 1985.

Björkman, Annika, Letter dated Apr. 24, 1995 re Kamyr, Inc. Patent Application PCT/US94/03614 (WO 94/23120).

PCT International Search Report, Kvaerner Pulping Technologies AB, Nat. Appln. No. 9501572-3, filing date of Apr. 28, 1995.

*Primary Examiner*—Donald E. Czaja
*Assistant Examiner*—Dean T. Nguyen
*Attorney, Agent, or Firm*—Ronald P. Kananen

[57] ABSTRACT

The present invention relates to a method for continuous cooking of kraft pulp in a single-vessel system (1), preferably a single-vessel hydraulic digester, with chips being conveyed from a high-pressure feeder (2) in a transfer line (2A, 4A) to a first end (3) of the digester (1), the chips being impregnated, in a liquid containing black liquor, in a concurrent impregnation zone (5), the chips being cooked in a cooking zone (6) subsequent to the impregnation zone, hot black liquor (7) being extracted from at least one extraction screen section (8), and cooked pulp being discharged (9) at the other end of the digester. The chips are, when they leave the high-pressure feeder (2), included in a first liquid, which first liquid is in the main separated from the chips in a liquid exchanger (4) installed in the transfer line (2A, 4A) and is replaced by a second liquid which contains black liquor.

24 Claims, 1 Drawing Sheet

METHOD FOR IMPREGNATION IN A SINGLE-VESSEL HYDRAULIC DIGESTER

DESCRIPTION

1. Technical Field

The present invention relates to a method for continuous cooking of cellulose-containing fiber material, preferably by the kraft process, in a single-vessel system, the fiber material at the start of the cooking process being impregnated with black liquor, primarily for the purpose of achieving good pulp strength, but in a preferred embodiment also for the purpose of achieving relatively low energy consumption. The invention can be used expediently when converting old single-vessel digesters for black liquor impregnation.

2. State of the Art and Problems

In existing kraft digesters, black liquor is used only in limited quantities, i.e., most often in quantities which are substantially less than 50% of the total liquid content in the impregnation zone of the digester. The remaining quantity of externally added liquid normally consists of white liquor in the main. It has been found that this considerable charge of white liquor at such an early stage in the cooking process has a negative effect on the tear strength of the cooked fibers. In order to achieve selective cooking, it has been found that there should be a relatively high content of sulfide ions and a low content of hydroxide ions at the start of cooking.

A related problem concerns difficulties in obtaining a uniform cooking in existing single-vessel digesters, particularly of the hydraulically filled type. In order to achieve a uniform and selective cooking, it is desirable to be able to impregnate the chips in the upper part of the digester with hot black liquor, which has a relatively high content of sulfide ions and a low content of hydroxide ions. However, a high temperature at the top of the digester leads to a high temperature in the transfer circulation which conveys the chips from a so-called high-pressure feeder, that is to say a pressure sluice which transfers the chips together with liquid from a low-pressure system to a high-pressure system. Thereafter, the liquid is in the main separated from the chips with the aid of a top separator at the top of the digester and is returned to the high-pressure feeder. If this returned liquid has a temperature which exceeds the boiling point in the low-pressure system, the liquid will flash in the high-pressure feeder, said flashing manifesting itself in the form of bangs.

U.S. Pat. No. 3,303,088 (Gessner) discloses a method for continuously cooking cellulose-containing fiber material in a single-vessel system, with chips being introduced at a first end of the digester, white liquor being added at a position at said first end, the chips being impregnated in a concurrent impregnation zone, the chips being cooked in a cooking zone downstream of the impregnation zone, hot black liquor being extracted from at least one screen section, black liquor being added to said impregnation zone, and cooked pulp being discharged at the other end of the digester. Gessner further shows that the liquid extracted from the first screen section, which is arranged downstream of the point of addition of the black liquor, is returned to the digester by first being supplied to a container in which white liquor and extracted impregnation and cooking liquids are mixed. As a result of this recirculation, there is a substantial build-up in the content of, inter alia, volatile sulfur and terpene compounds in the impregnation and cooking liquids. In addition to this, the procedure according to Gessner does not offer a sufficiently rapid heating of the cooking liquid for achieving optimal process conditions. Furthermore, it also emerges that Gessner's procedure for continuously cooking cellulose-containing material does not involve process parameters which are necessary for achieving optimal conditions, such as, for example, the correct liquor-to-wood ratio for obtaining the desired movement of the chip column in the digester.

From WO 94/23120 (Collins) it is known to thermally insulate the high-pressure feeder from the digester by means of replacing a first, relatively cold liquid with a second, relatively hot liquid outside the digester, in the transfer line from the high-pressure feeder to the digester. This change of liquids is preferably carried out with the aid of a free-standing, upward-feeding top separator. The first, relatively cold liquid is returned to the high-pressure feeder, as a result of which a first circulation is obtained within the transfer circulation. The second, relatively hot liquid consists to a large extent of liquid from the top of the digester, which liquid is further heated up before being supplied to the liquid exchanger. By means of the return of liquid from the top of the digester to the liquid exchanger, a second circulation is obtained within the transfer circulation. However, the problem concerning black liquor impregnation in a single-vessel digester is not mentioned in WO 94/23120. Moreover, the system which is described cannot be used for supplying the necessary amount of hot black liquor in connection with the transfer, since WO 94/23120 teaches that the liquid in the second, hotter circulation shall to a large extent consist of liquid which has been returned from the top of the digester.

A further disadvantage of the system according to WO 94/23120 is that the liquid exchanger which is used contains a slotted screening basket with a relatively small open area. This results in a considerable susceptibility to incrustation, which would further increase if black liquor were supplied.

Other types of conventional liquid exchangers, for example with bar strainers in the screening basket, also present disadvantages which can prove to be damaging. Such a screening body consisting of bars gives poor stability with respect to torsional stresses, for example. It is therefore common for the screening body to deform as a result of the torsional stresses it is subjected to during operation from the effect of the screw, and the chips passing through, and also tramp material which is caught between the screw blades and the screening bars. The whole screening body can be destroyed and then has to be replaced with a new one. By reason of the complicated structure of a conventional screening body, it is not possible to achieve adequately small tolerances in respect of the internal diameter of the screening body, which fact means that the screw which is to be incorporated in the separator has to be manufactured afterwards on the basis of the dimensions of the screening body. The screening body and screw therefore have to be manufactured in pairs, and when the screening body has to be replaced on account of deformation, it is also necessary to replace the screw with an entirely new screw which matches the new screening body.

Solutions and advantages

The object of the present invention is to provide an improved method for continuous cooking of fiber-containing cellulose material, preferably softwood, which method eliminates the above-mentioned disadvantages. The invention is especially suitable for use in conjunction with the conversion of existing single-vessel digesters to include black liquor impregnation in the concurrent zone. The characteristic feature of the invention is that the chips, when they leave the high-pressure feeder, are included in a first liquid, which first liquid is in the main separated from the chips in a liquid exchanger installed in the transfer line, and is replaced by a second liquid.

A further aspect of the invention is that said second liquid contains black liquor in a quantity in excess of 40%, preferably in excess of 50%, and more preferably in excess of 60%, of the total quantity of liquid.

According to a further aspect of the invention, a screening basket is used in the liquid exchanger in accordance with Swedish Patent No. SE-C-501 110 (which corresponds to U.S. Pat. Nos. 5,503,323 and 5,504,987). Such a screening body is designed in such a way that it withstands the stresses which normally arise during operation, without being seriously deformed. In addition, such a screening basket does not have to be manufactured along with the screw. Since such a screening basket additionally has about 30% more open area than a slotted screening basket, the system can be run for a considerably longer time without maintenance. Indications are that the system can be run about three times longer without the need for maintenance.

According to a further aspect of the invention, the liquor-to-wood ratio in said impregnation zone should exceed 3:1, preferably exceed 3.5:1, or more preferably be equal to or greater than 4:1. In addition, the liquid extracted from the first screen girdle which is arranged downstream of the point of addition of said black liquor should in the main, i.e., in excess of 50%, preferably in excess of 70%, more preferably in excess of 90%, be led away from the digester.

According to a further aspect of the invention, white liquor is supplied to said first and/or said second liquid and expediently to one or more cooking circulations and, if appropriate, to the countercurrent washing if extended cooking is desired.

One advantage of the invention is that a better plug flow is obtained in the upper part of the digester. This is due, on the one hand, to the fact that the downward flow of liquid is considerable, and, on the other hand, to the fact that an increased difference in density between chips and liquid is achieved, compared with the situation in a digester having a lower temperature at the top.

Another advantage is that the number of cooking circulations downstream of said first screen girdle can be reduced, since heating largely takes place externally, outside the digester.

Yet another advantage is that there is less risk of clogging of the top screen of the digester, and consequently less risk of stoppages in production. This is due to the fact that when the invention is put into application, there are two separators, namely one in the transfer line and one at the top of the digester, and these can share the incrustation load.

When converting older, existing digesters, the present invention affords the possibility of achieving a uniform and selective cooking, with accompanying improved pulp quality. This is especially true in connection with the introduction of an extra circulation with white liquor charging and high flow in the countercurrent washing, by which means so-called isothermal cooking ITC™ in accordance with patent application SE 9203462 can be achieved.

A further advantage is that bangs as a consequence of liquid flashing in the high-pressure feeder can be avoided.

BRIEF DESCRIPTION OF THE DRAWING

The invention will be explained in greater detail hereinafter with reference to the drawing which is a diagrammatic representation of a preferred flow plan for continuous cooking of fiber material in accordance with the present invention.

DETAILED DESCRIPTION OF THE INVENTION

Figure 1:
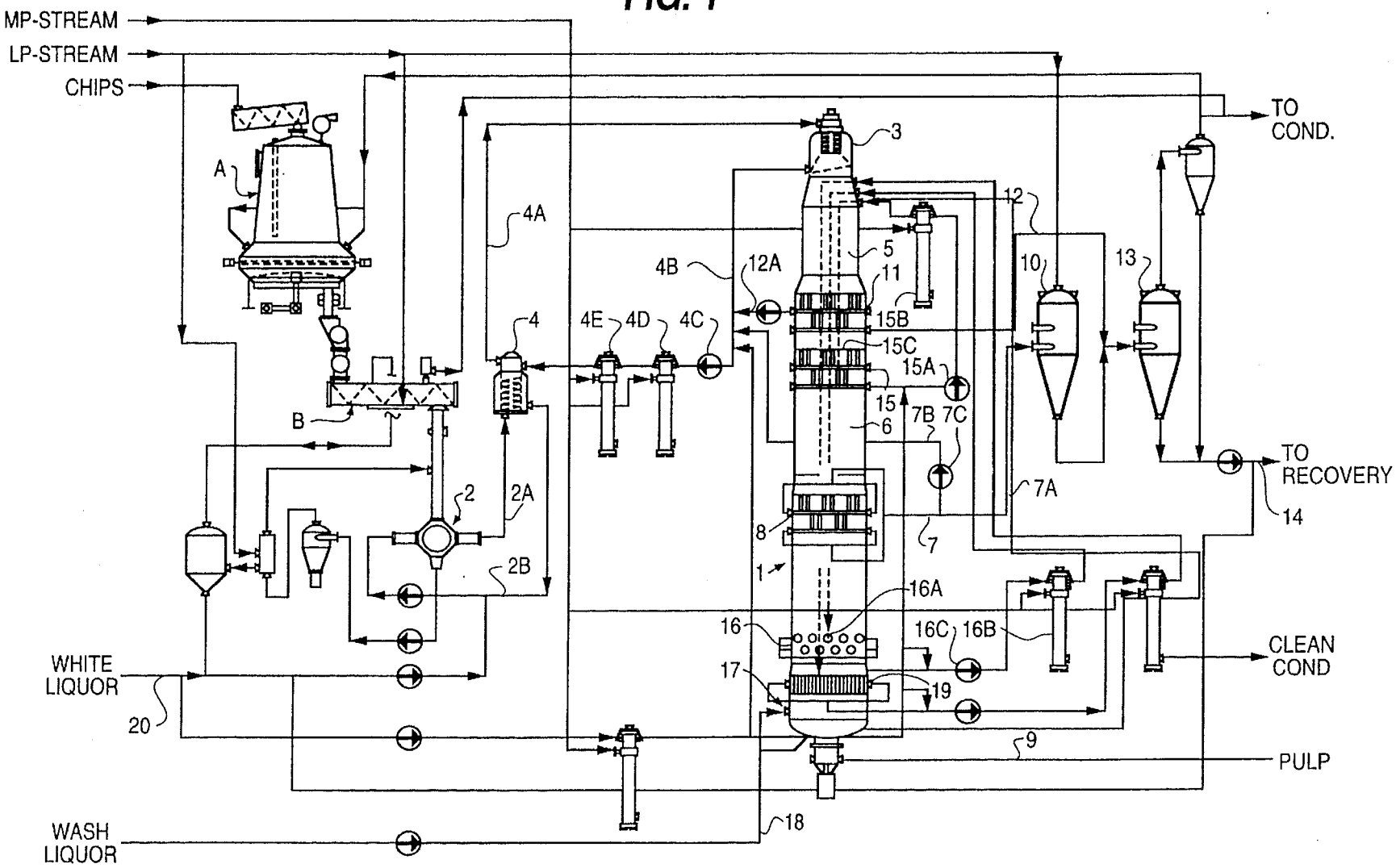

The installation shown in the FIGURE comprises a chip bin (A), a horizontal steaming vessel (B) and a digester (1). The broken-up fiber material, which preferably consists of wood chips, is fed from the chip bin (A) in a known manner through the steaming vessel (B) to a high-pressure feeder (2). The function of the high-pressure feeder is to channel the chips from a relatively low pressure to a higher pressure of about 10 bar exclusive of static height difference. The chips, which are contained in a first, relatively cold liquid having a temperature of about 115° C., are fed from the high-pressure feeder through a transfer line (2A) up toward the digester top (3) (see, for example, SE B 468053). According to the invention, a liquid exchanger (4) is installed in this line, preferably an upward-feeding separator of the type which is normally used at the top of a treatment vessel. An example of a screen arrangement which can be used in such a liquid exchanger is shown in Swedish Patent No. SE-C-501 110 (which corresponds to U.S. Pat. Nos. 5,503,323 and 5,504,987). The chips are in this case fed upward in a screening basket, at the same time as the first liquid, in which the chips are contained, is extracted and recirculated (2B) to the high-pressure feeder. A first transfer circulation (2A, 2B) is formed in this way. A second, relatively hot liquid is supplied (4B) to the chips in the liquid exchanger, and the chips thereafter leave the liquid exchanger and are conveyed to the digester top in a transfer line (4A). At the digester top (3) there is a screen for separating off a certain amount of the liquid with which the chips are transported up to the top. This liquid is recirculated via a pump (4C), and if appropriate via one or more heat exchangers (4D, 4E) with the aid of which the temperature can be raised further, to the liquid exchanger (4), by which means a second transfer line (4A, 4B) is formed.

The liquid exchanger (4), which is shown, for example, in U.S. Pat. Nos. 5,503,323 and 5,504,987, comprises a screen body with a plurality of axial screening bars and a plurality of support rings. The support rings are arranged at a distance from one another and surround the screening bars and are connected to the screening bars. The support rings of the screen body are provided on their inner parts with identical, uniformly distributed radial recesses for receiving the foot sections of the screening bars. The width of the recesses are matched to the thickness of the foot sections of the screening bars in such a way that the screening bars are received snugly in the recesses and are substantially free from play. The screening bars are connected permanently to the support rings by welding. Each screening bar has a section modulus $W_y$ (i.e., resistance to bending) which is greater than 100 $mm^3$, and preferably greater than 150 $mm^3$. The screening bars have a maximum width exceeding 6 mm, and preferably exceeding 8 mm. The gaps between the screening bars are preferably 3–5 mm.

The preferred embodiment according to the invention, as shown in the figure, demonstrates the use of a hydraulic digester which, in contrast to a steam/liquid phase digester, is hydraulically filled with liquid and therefore uses a downward feeding screw in the top screen for feeding the chips. The chips then move slowly downward with the chip column in a liquor-to-wood ratio which is about 2.0:1 to 4.5:1, preferably between 3:1 and 4:1. The temperature in this upper part (3) of the digester is normally about 110°–120° C., but is sometimes as much as 135° C. The liquid moves in this upper part concurrent to the chip column. Black liquor (7) is extracted from the digester at the extraction screen section (8) and part of it is fed via the line (7A) to a first flash cyclone (10), while another part is conveyed via the line (7B), with the aid of a pump (7C), to the second transfer circulation (4A, 4B), preferably to the suction side of the pump (4C).

A first screen section (11) is arranged at a given distance from the digester top. The zone above this screen section is called the impregnation zone (5). At this first screen section (11), a quantity of impregnation liquor is drawn off (12) such that the desired liquor-to-wood ratio after addition of white liquor is maintained. In order to minimize the build-up of released material, a substantial part of this extracted liquor (12) is led away, in accordance with a preferred embodiment, to a second flash cyclone (13) from which the liquor (14) is led to recovery. The steam released from the second flash cyclone (13) is used, as is customary, at another location in the system. A fairly small part of the extracted liquid (12A) can be returned to the second transfer circulation (4A, 4B), principally for the purpose of achieving temperature equalization, preferably to the suction side of the pump (4C).

The black liquor (7) from the extraction screen section (8) has a temperature of about 155°–165° C. and is supplied to the second transfer circulation in a quantity which is such that the liquor-to-wood ratio in the impregnation zone (5) preferably increases by at least a ½ unit, preferably by 1 unit, and in some cases by as much as 1½ units. According to the most preferred form of the invention, an addition of hot black liquor is made which is sufficiently great to obtain a liquor-to-wood ratio of between 4:1 and 5:1. At 4:1 the liquid consists of approximately just under one part white liquor, one part wood liquid and just over two parts black liquor, in accordance with a preferred example. The liquid in the second transfer circulation should include black liquor in a quantity in excess of 40%, preferably in excess of 50%, and more preferably in excess of 60% of the total quantity of liquid. The temperature which is in this case obtained in the impregnation zone is about 120°–165° C., preferably 140°–160° C., and still more preferably 150°–160° C. According to one aspect of the invention, the liquid in the second transfer circulation (4A, 4B) is heated in one or more heat exchangers (4E, 4D).

After having passed through the first screen section (11), the chip column continues downward and meets, directly below this first screen section (11), a cooking circulation (15) whose purpose it is to adjust the temperature of the cooking liquid up to the appropriate cooking temperature, i.e., preferably in excess of 150° C., more preferably in excess of about 155° C. In most cases, when this invention is not implemented, at least two such cooking circulations (15) are needed in order to achieve the desired temperature in the chip column, together with sufficiently good distribution. However, in the preferred case of the invention, one cooking circulation suffices, since heating for the most part takes place outside the digester. The cooking circulation (15) is placed quite near, ie. directly below, said first screen section (11).

The liquid extracted from the digester screen (15) is recirculated in a known manner, by means of a pump (15A) pumping the cooking liquid through a heat exchanger (15B) where the desired heating is obtained, and is reintroduced into the digester, preferably together with a new charge of white liquor with the aid of a central pipe whose mouth (15C) opens out approximately level with the screen section (15) itself. The flow in this circulation should be at least 15 $m^3$/air-dry pulp, preferably at least 20 $m^3$/ air-dry pulp. Following the digester screen (15), the chip column and its surrounding liquid have reached the desired cooking temperature, whereupon the chip column enters a cooking zone (6) and continues to move downward. After a fairly long distance corresponding to a dwell time of about 1–2 hours, the chips have moved down to a level with the extraction screen section (8), which has already been mentioned above. This extraction screen section corresponds to the sort of extraction screen which is normally always arranged on a continuous digester. The greater part of this extracted liquid is thus conveyed to the first flash cyclone (10) and is thereafter conveyed onward for recovery. Below the level of the extraction screen section (8), the chip column enters a countercurrent cooking zone. The chips thus encounter cooking liquid which has been extracted at the lower screen section (16), has been heated in a lower heat exchanger (16B) and has been recirculated, with the aid of a pump (16C), via a central pipe whose mouth (16A) opens out level with the screen section (16).

Washing liquid (18) is added at the lower end (17) of the digester, which washing liquid (18) thus moves in a conventional countercurrent manner and displaces hot liquor from the fiber material, and this permits subsequent cold blowing. Normally, there is also a screen section (19) with associated circulation in this lower part of the digester. The pulp is thereafter discharged through a feeding arrangement known per se and is led out through a line (9) for further processing.

In a preferred case, according to the invention, white liquor (20) is added at three positions. On the one hand it is added to the first transfer circulation (2A, 2B) and to the second transfer circulation (4A, 4B), and on the other hand it is added to the cooking circulation (15). The greatest part of the charge is made to the second transfer circulation (4A, 4B) and to the cooking circulation (15). It is of course also possible to add white liquor in the lower circulation (16) too, so that the alkali concentration is increased in the countercurrent zone, with approximately the same temperature expediently being maintained in all the cooking zones so that our patented ITC™ method is used.

The person skilled in the art will appreciate that the invention is not limited by what has been shown above, and instead can be varied within the scopes of the patent claims which follow. An MCC layout is of course also conceivable to the person skilled in the art. Similarly, it is entirely possible to use the concept for cooking hardwood pulp too. In addition, the person skilled in the art will appreciate that a number of modifications can be made within the scope of the invention, such as, for example, selecting the exact temperature and alkali concentrations, etc.

Moreover, instead of pumping hot black liquor directly from the extraction screen (8) to the second transfer circulation (4A, 4B), it is possible to pump the hot black liquor collected from the first flash cyclone (10) up to the second transfer circulation. The temperature of the black liquor is in this case lower, but the advantage gained is that the black liquor contains less air, and this can be of great advantage in connection with eliminating foaming problems in the digester. It is additionally possible, in the case of certain existing digesters, to use the existing screen arrangement and lead off only part of the extracted liquid from the upper screen girdle and, in conformity with a conventional cooking circulation, to recirculate the remainder and in so doing expediently also effect heating and add white liquor. Of course, this last-mentioned principle can also be used in connection with new constructions. Further on, single-vessel steam phase digesters can also be used.

I claim:

1. A method for continuous cooking of kraft pulp in a single vessel digester system, said method comprising the steps of:

(a) conveying chips through a transfer line having a first portion and a second portion, said transfer line extending from a high-pressure feeder to a first end of the digester;

(b) adding a first liquid to said chips during said first portion of said transfer line;

(c) separating said first liquid from said chips between said first and second portions of said transfer line through the use of a liquid exchanger installed in said transfer line;

(d) replacing said first liquid with a second liquid by adding said second liquid to said chips in said second portion of said transfer line through the use of said liquid exchanger;

(e) introducing said chips of step (d) into said digester at said first end of said digester;

(f) impregnating said chips in said digester in a concurrent impregnation zone and in a liquid containing black liquor;

(g) cooking said chips and heating said black liquor in said digester in a cooking zone subsequent to said impregnation zone whereby a combination of cooked pulp and black liquor is produced;

(h) extracting said black liquor from the combination of cooked pulp and black liquor through the use of at least one extraction screen section;

(i) adding black liquor to said second liquid by recirculating a portion of said extracted black liquor to said second liquid, whereby a quantity of black liquor in said second liquid is increased to more than 40% of the total quantity of said second liquid; and (j) discharging cooked pulp at the second end of said digester.

2. The method of claim 1, wherein said percentage is in excess of 50%.

3. The method of claim 2, wherein said percentage is in excess of 60%.

4. The method of claim 1, further comprising the step of raising the temperature of said second liquid.

5. The method of claim 1, wherein the ratio of liquor-to-wood in said impregnation zone exceeds 3:1.

6. The method of claim 5, wherein said ratio exceeds 3.5:1.

7. The method of claim 5, wherein the ratio is 4:1 or greater.

8. The method of claim 1, further comprising the steps of extracting liquid containing black liquor from said liquid and pulp combination in said digester via an uppermost screen girdle positioned between said impregnation zone and said cooking zone, and sending greater than 50% of said liquid extracted from said uppermost screen girdle to a recovery system.

9. The method of claim 8, wherein said percentage of said liquid extracted from said uppermost screen girdle sent to a recovery system exceeds 70%.

10. The method of claim 8, wherein said percentage of said liquid extracted from said uppermost screen girdle sent to a recovery system exceeds 90%.

11. The method of claim 1, further including the step of charging said first and second liquids with a white liquor.

12. The method of claim 11, wherein said charge to said second liquid is greater than said charge to said first liquid.

13. The method of claim 1, wherein said recirculating is done by a pump which pumps said extracted black liquor directly from said extraction screen into said second liquid.

14. The method of claim 1, wherein the temperature of said extracted black liquor exceeds 140° C.

15. The method of claim 1, wherein the temperature of said extracted black liquor exceeds 150°.

16. The method of claim 1, wherein the temperature of said extracted black liquor exceeds 155° C.

17. The method of claim 1, further comprising at least one cooking circulation step performed in said digester between said impregnating step and said cooking step whereby a predetermined heating of the recirculated cooking liquid and a predetermined addition of white liquor are obtained.

18. The method of claim 17, wherein only one cooking circulation step is employed.

19. The method of claim 1, wherein said liquid exchanger comprises a screen body with a plurality of axial screening bars and a plurality of support rings which are arranged at a distance from one another and which surround and are connected to the screening bars.

20. The method of claim 19, wherein said support rings of said screen body are provided on their inner parts with identical, uniformly distributed radial recesses for receiving the foot sections of the screening bars, and in that the width of the recess is matched to the thickness of said foot sections of said screening bars in such a way that said screening bars are received snugly in said recesses and substantially free from play.

21. The new method of claim 19, wherein said screening bars are connected permanently to said support rings by welding, and further wherein each said screening bar has a resistance to bending Wy which is greater than 100 $mm^3$.

22. The method of claim 21, wherein said resistance to bending is greater than 150 $mm^3$.

23. The method of claim 19, wherein said screening bars have a maximum width exceeding 6 mm, and further wherein the gaps between said screening bars are 3–5 mm.

24. The method of claim 23, wherein said maximum width exceeds 8 mm.

* * * * *